US005729935A

United States Patent [19]

Schiedegger et al.

[11] Patent Number: 5,729,935

[45] Date of Patent: Mar. 24, 1998

[54] GABLE VENT

[75] Inventors: Charles E. Schiedegger, Metamora; Richard J. MacLeod, Brighton, both of Mich.

[73] Assignee: Tapco International, Plymouth, Mich.

[21] Appl. No.: 724,531

[22] Filed: Sep. 30, 1996

[51] Int. Cl.[6] ..... E06B 1/04

[52] U.S. Cl. ..... 52/198; 52/27; 52/202; 52/211; 52/302.1; 52/473; 52/745.15; 454/277; 454/283

[58] Field of Search ..... 52/27, 28, 58, 52/60, 61, 62, 95, 198, 199, 202, 211, 212, 302.1, 302.6, 473, 474, 476, 489.2, 506.01, 507, 509, 510, 512, 745.15, 745.16; 454/250, 277, 283, 367

[56] References Cited

U.S. PATENT DOCUMENTS

| | | | |
|---|---|---|---|
| 4,327,841 | 5/1982 | Wimberly . | |
| 4,676,145 | 6/1987 | Allred | 52/198 X |
| 4,726,152 | 2/1988 | Vagedes et al. . | |
| 4,785,596 | 11/1988 | Wiley et al. | 52/198 |
| 4,875,317 | 10/1989 | Logan et al. | 52/302.1 X |
| 4,875,318 | 10/1989 | MacLeod et al. . | |
| 4,892,322 | 1/1990 | Koza et al. | 454/277 X |
| 4,899,647 | 2/1990 | Garries et al. | 52/473 X |
| 4,911,066 | 3/1990 | Carew | 52/473 X |
| 4,915,023 | 4/1990 | Porter | 454/283 |
| 4,920,708 | 5/1990 | MacLeod et al. . | |
| 5,000,409 | 3/1991 | MacLeod et al. . | |
| 5,144,777 | 9/1992 | Fishel et al. | 52/58 X |
| 5,293,920 | 3/1994 | Vagedes . | |
| 5,303,522 | 4/1994 | Vagedes . | |
| 5,326,060 | 7/1994 | Chubb et al. . | |
| 5,349,799 | 9/1994 | Schiedegger et al. . | |
| 5,397,093 | 3/1995 | Chubb et al. | 52/28 X |
| 5,402,611 | 4/1995 | Vagedes . | |
| 5,471,803 | 12/1995 | Logan et al. | 52/212 |
| 5,491,936 | 2/1996 | Logan et al. . | |
| 5,577,702 | 11/1996 | Chubb et al. | 52/28 X |
| 5,596,852 | 1/1997 | Schiedegger | 52/198 X |

*Primary Examiner*—Carl D. Friedman
*Assistant Examiner*—Kevin D. Wilkens
*Attorney, Agent, or Firm*—Harness, Dickey & Pierce, P.L.C.

[57] ABSTRACT

A gable vent assembly comprising a mounting ring and a cover member. The mounting ring includes a plurality of distinct lengths, one of which is formed in two parts to enable easy manipulation of portions thereof when the mounting ring is positioned over an opening in a wall having siding thereon. The cover member includes a plurality of shoulder portions which engage with securing grooves in the mounting ring such that the gable vent member may be secured to the mounting ring without the need for fastening elements such as threaded screws, staples or the like. The cover member and mounting ring are also adjustably positionable relative to each other to accommodate different thicknesses of siding.

21 Claims, 10 Drawing Sheets

FIG 4A
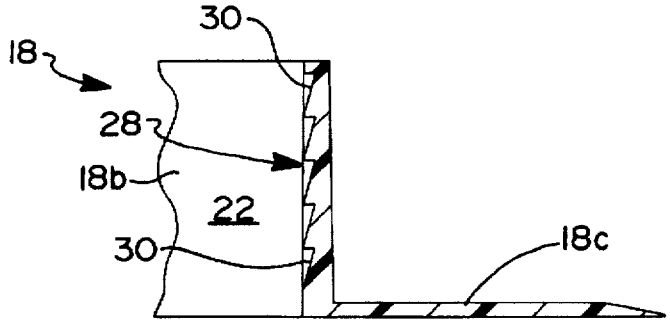
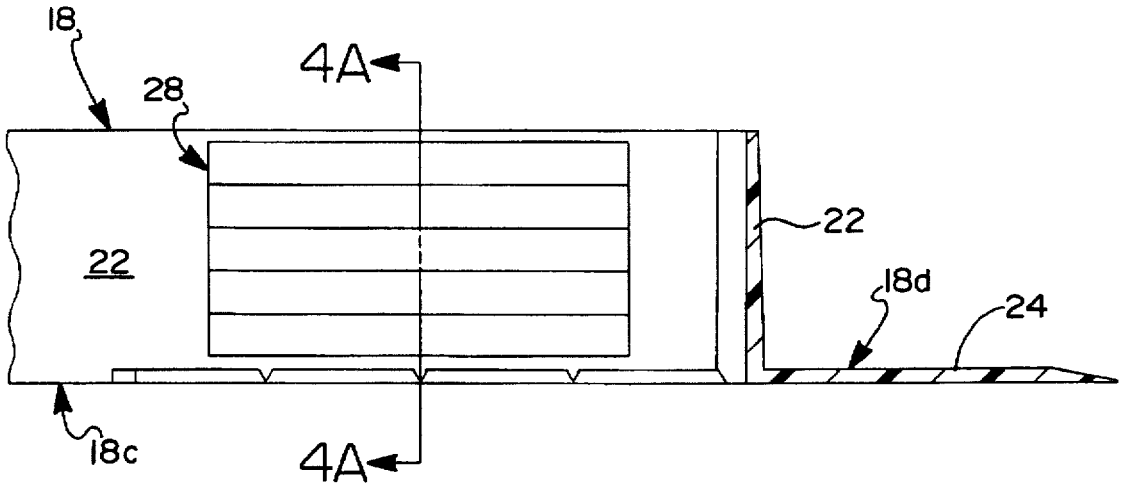
FIG 4

FIG 8
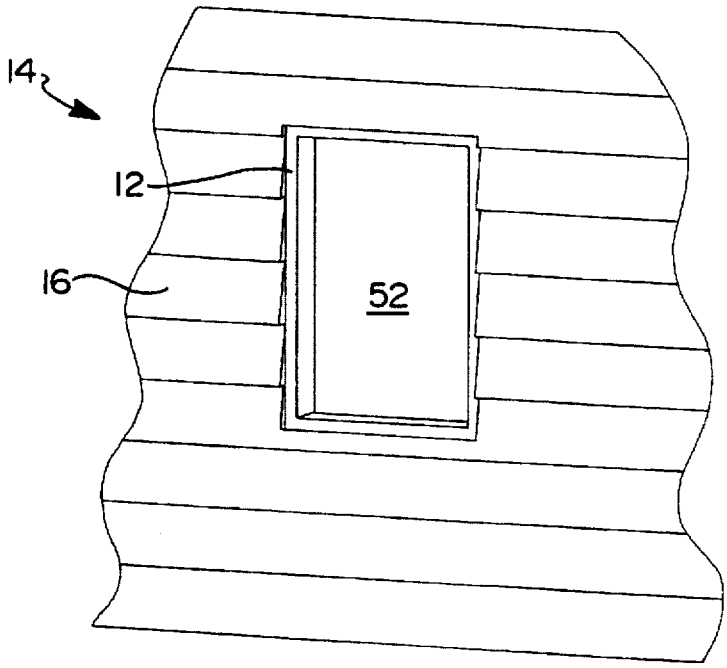
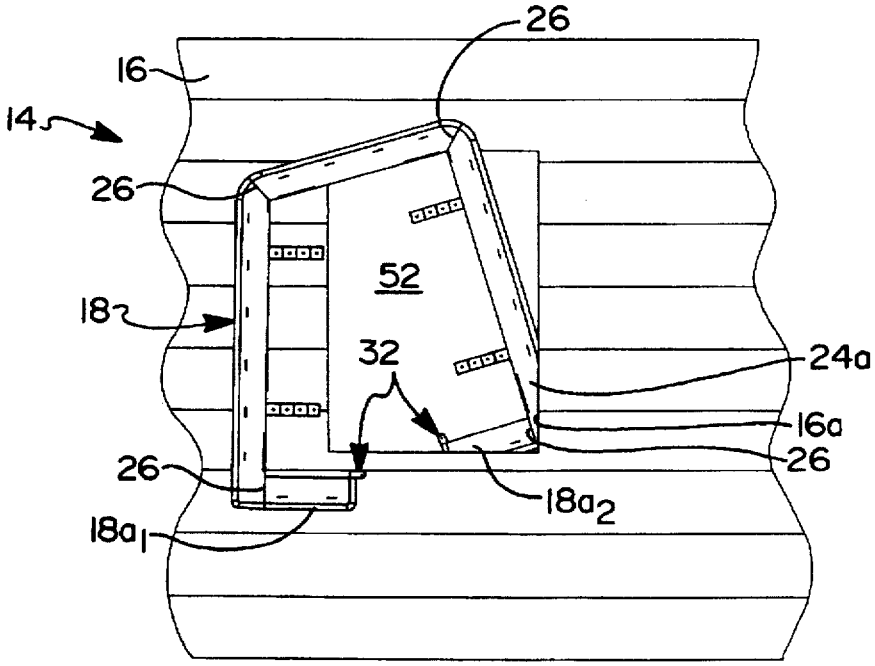
FIG 9

FIG 10
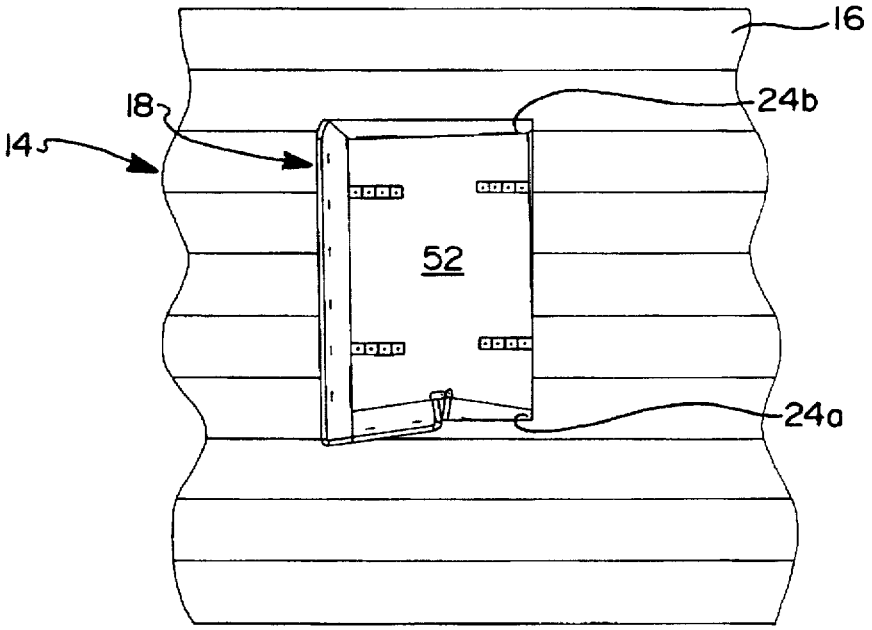
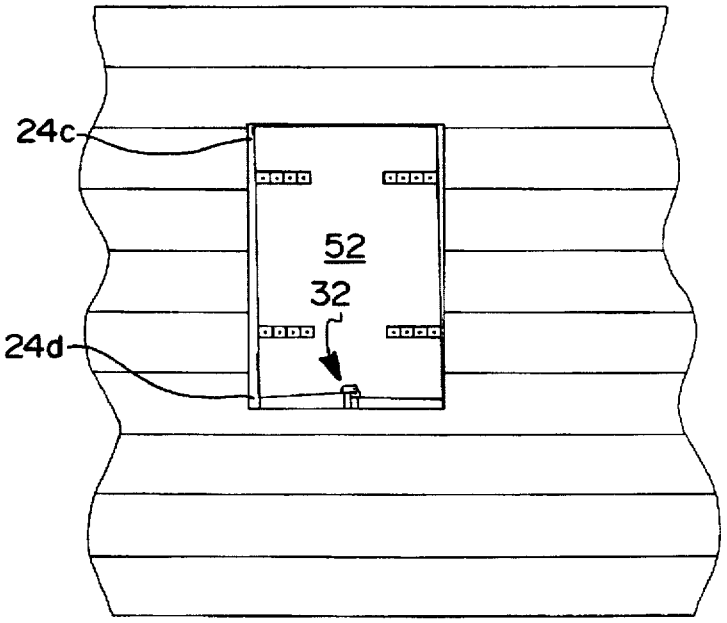
FIG 11

FIG 12B
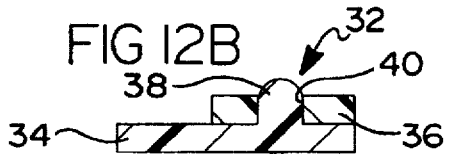
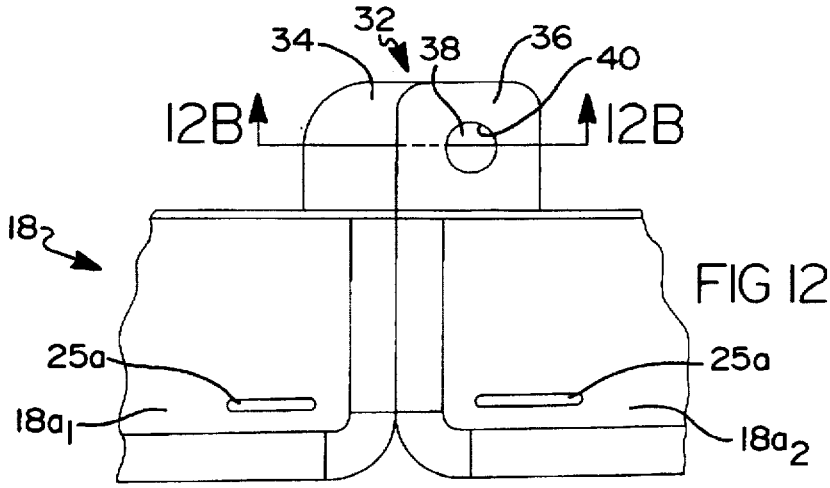
FIG 12A
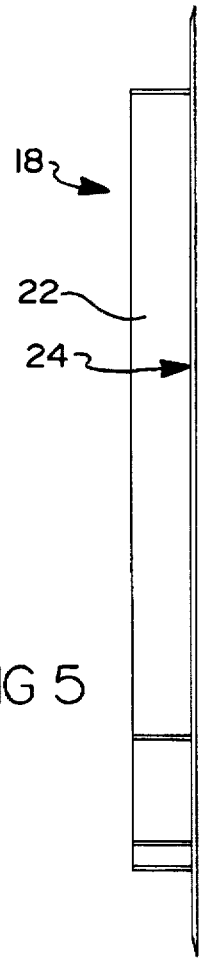
FIG 5
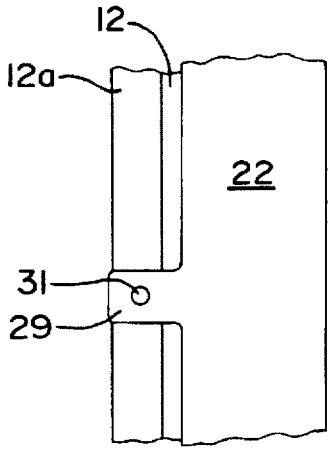
FIG 12C

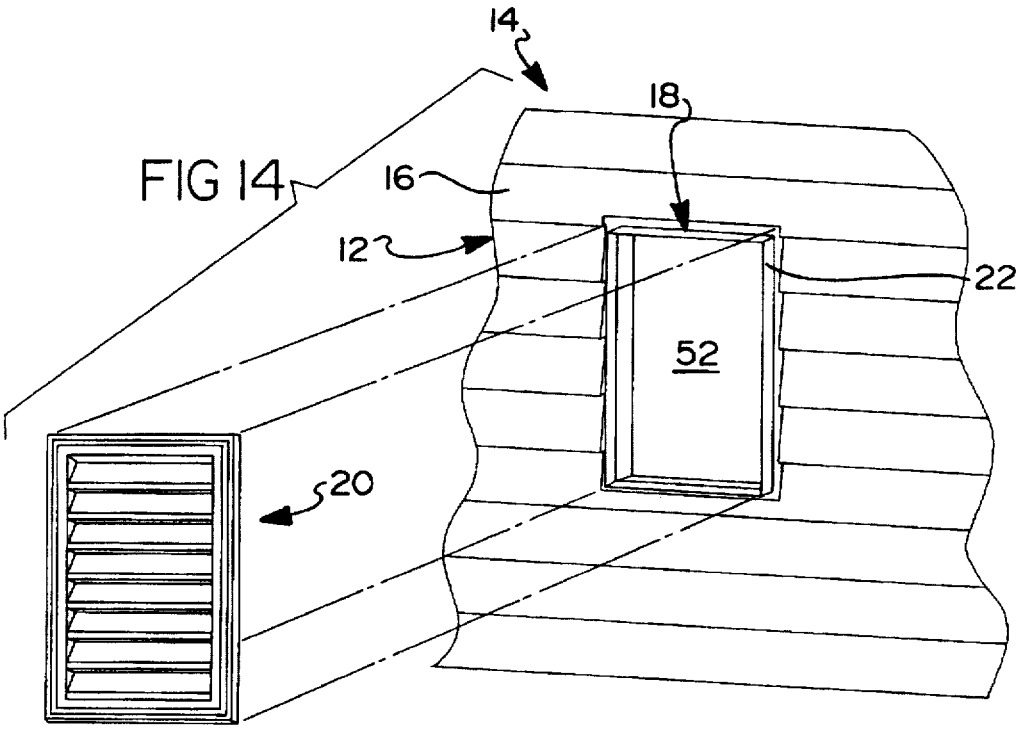
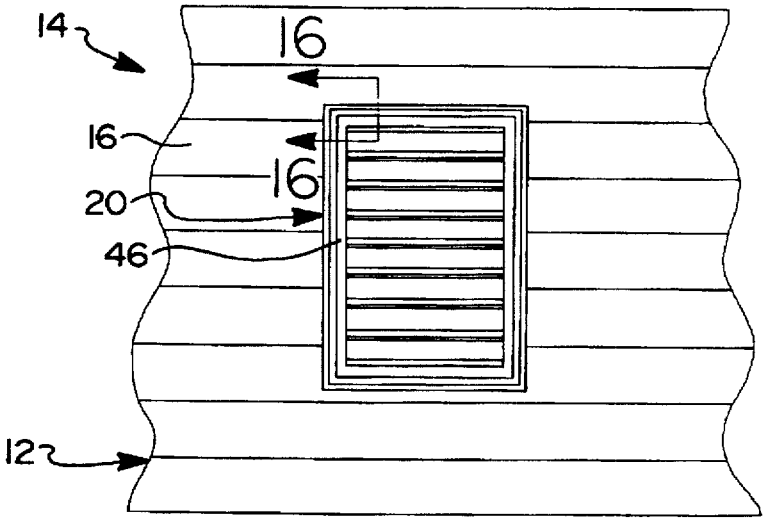
FIG 15

GABLE VENT

TECHNICAL FIELD

This invention relates generally to building products for use with residential and commercial building structures, and more particularly to a gable vent adapted to be installed on new construction or easily retrofitted to existing structures.

DISCUSSION

Gable vents are used in many residential and commercial buildings to provide ventilation to the attic area of the building. Gable vents come in many shapes and sizes and are often made from wood. Such vents, if made from wood, are typically nailed or similarly secured to an opening cut into a wall of a building and thereafter stained or painted to match the exterior of the building.

If the gable vent is manufactured from wood, this will have several drawbacks. Initially, wood gable vents are affected by the elements and can suffer from splitting, cracking, warping or insect damage. Wood gable vents can also be easily damaged before installation such as if accidentally stepped on by a worker at a work site.

Some gable vents are manufactured from plastic. While this alleviates some of the drawbacks inherent in wood gable vents, such plastic gable vents are not always as easily securable to existing buildings as they are new buildings which are under construction and which do not have siding or some other like, decorative exterior surface already installed. In such instances, securing a replacement gable vent to a building already having exterior siding installed can involve significant time and labor expense. Often, one or more lengths of siding must be removed and cut to enable sufficient room for a portion of the gable vent to be fixedly secured to the exterior surface of the building wall. Accordingly, replacing a gable vent is not as simple and straight forward as cutting out the existing, damaged gable vent and installing the new gable vent.

Thus, there is a need for a gable vent which is readily and easily securable to an exterior surface of a building regardless of whether the exterior surface is covered with vinyl or aluminum siding or some other like decorative surface material, and further which does not require a portion of the surface material to be removed or cut before the new gable vent is installed.

There is further a need for a gable vent which is comprised of at least two components: a mounting ring which may be fixedly secured to the exterior surface of a building without requiring existing siding to be first removed, and a decorative gable vent which may be releasably yet securely coupled to the mounting ring. Such an assembly would allow the gable vent alone to be replaced if same should become damaged, discolored or otherwise in need of replacement. Such an arrangement would also reduce the time necessary to replace the gable vent because there would be no need to remove the siding.

SUMMARY OF THE INVENTION

The above requirements are met by a gable vent assembly in accordance with a preferred embodiment of the present invention. The gable vent assembly of the present invention comprises an independent mounting ring and an independent cover member. The mounting ring includes one or more flange portions which may be secured directly to the exterior surface of a building over the opening in the building wall where the original gable vent was secured. The flanges are further formed so as to permit them to be slid underneath portions of vinyl or like siding which surround the opening if such siding is already secured to the building. Preferably at least a pair of flexible attachment straps integrally formed with the mounting ring may be secured to framing forming the gable vent opening by nails, threaded screws or staples. In this manner the entire mounting ring is supported over the opening without the need for removal of the siding strips. Only minor trimming of the siding around the gable vent opening may be required prior to installing the mounting ring.

The mounting ring further includes a mounting wall having a least one first securing portion which is accessible after the mounting ring is secured over the opening in the building wall. The cover member has at least one second securing portion which is positioned so as to engage with the first securing portion when the cover member is positioned over the mounting ring. The first and second securing portions interengage to hold the cover member to the mounting ring without the need for any external fastening elements such as staples, threaded screws, adhesives or the like. The assembly of the cover member to the mounting ring can thus be accomplished with minimal time and expense, without the need for any special tools and without complicated installation procedures.

In the preferred embodiment the mounting ring includes a mounting wall having a plurality of distinct lengths, with one of said lengths being formed in two portions to permit the mounting wall to be easily manipulated during installation over a suitably sized opening in the building wall. Each of the portions includes interengaging structure allowing the portions to be secured together after the mounting ring is positioned over the opening in the building wall. The mounting wall forms a predetermined shape such as a rectangle when completely secured over the opening. Preferably at least two corners of the flanges have grooves which can be cut easily through with a utility knife. This further increases the flexibility of the mounting ring to ease the insertion of the flanges behind edges of siding when the gable vent assembly is being placed on a building wall having siding thereon. In the preferred embodiment the flange portions of the mounting ring include a plurality of slots for enabling external fastening elements such as nails or threaded screws to be used to secure the flanges to the exterior surface of the building around the opening in the wall of the building. In this manner the mounting ring may be secured to new construction where the exterior surface of the building walls do not have any form of siding installed.

The cover member of the present invention includes an interior projecting wall on which preferably a plurality of the second securing portions are formed. Each of the second securing portions comprises a shoulder portion positioned so as to interengage with an associated first securing portion on the mounting ring. In the preferred embodiment a plurality of first securing portions are provided and each first securing portion includes a plurality of grooves formed in the mounting wall of the mounting ring. Each of the first securing portions are positioned to engage with the shoulder portions on the interior wall portion of the cover member to allow the cover member to be secured to the mounting ring and adjustably spaced from the mounting ring to accommodate differences in thickness of the siding or other decorative material secured to the exterior surface of the building.

The method of the present invention involves placing the mounting ring over an opening in a wall of a building and manipulating the various lengths of the mounting ring such that each of the flanges is positioned behind edges of the siding and the mounting ring circumscribes the opening in the building wall. If the wall does not have any siding or other decorative surface covering, then the flange may be secured by threaded screws or nails directly to the exterior surface of the building. The cover member is then positioned over the mounting ring such that an internal wall portion of the cover member fits closely adjacent a mounting wall of the mounting ring, and further such that the first securing portions on the mounting ring engage with the second securing portions on the cover member to hold the cover member securely to the mounting ring.

The gable vent assembly is manufactured from a thermoplastic which is lightweight, flexible, relatively inexpensive and resistant to the elements. As such, the gable vent assembly will not crack, split, swell or otherwise be affected by temperature variations which would readily affect natural wood. Since the gable vent assembly is manufactured from a thermoplastic, it can be manufactured in a variety of colors and even painted, if needed, to match the existing siding or other trim work on a building.

BRIEF DESCRIPTION OF THE DRAWINGS

FIG. 4 is a cross sectional view according to section line 4—4 in FIG. 2;

FIG. 4A is a cross sectional view according to section line 4A—4A in FIG. 4;

FIG. 5 is a side view according to directional line 5—5 in FIG. 2;

FIG. 8 is a view of an exterior wall of the building having siding thereon and showing the opening formed after an existing gable vent has been removed, with the opening ready to receive the mounting ring;

FIG. 9 is a view showing one corner of the mounting ring being positioned behind the siding;

FIG. 10 is a view showing the upper right corner of the mounting ring being positioned behind the siding;

FIG. 11 is a view showing the upper and lower left corners of the mounting ring being positioned behind the siding;

FIG. 12A is a plan view of the connecting portion showing the two portions of the lower length of the mounting ring held releasably together;

FIG. 12B is a cross sectional view in accordance with section line 12B—12B in FIG. 12A showing the two portions of the mounting ring secured together;

FIG. 12C is a side view of a portion of the gable vent assembly shown in FIG. 11 showing one of the connecting straps secured to framing forming the opening in the building wall;

FIG. 14 is a perspective view of the cover member aligned with the mounting ring in position to be attached to the mounting ring;

FIG. 15 is a view showing the cover member secured to the mounting ring.

DETAILED DESCRIPTION OF THE PREFERRED EMBODIMENT

Figure 1:
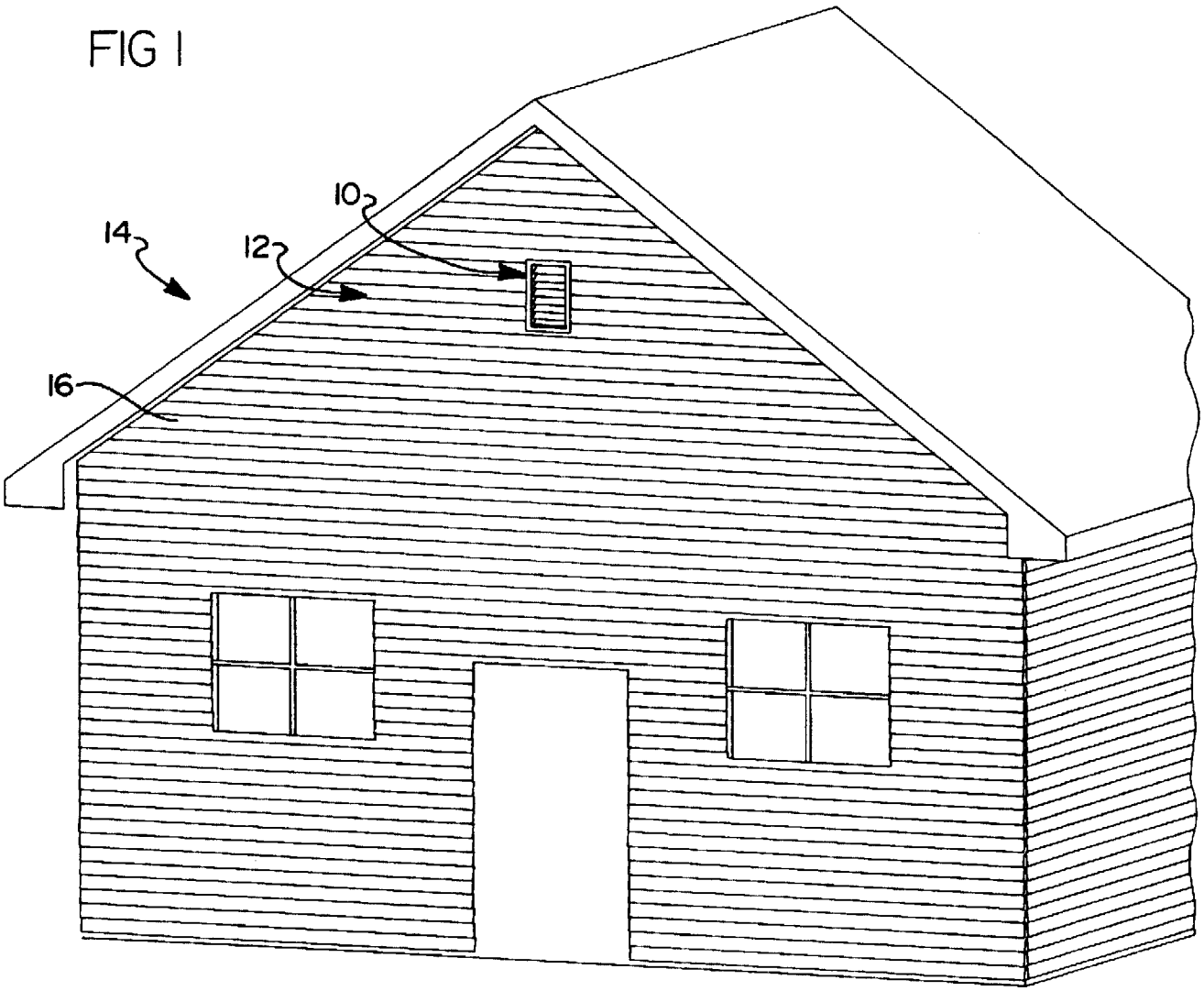
FIG. 1 is a perspective view of a portion of a house showing a gable vent in accordance with a preferred embodiment of the present invention installed on an outer wall of the building.

Referring to FIG. 1, there is shown a gable vent assembly 10 in accordance with a preferred embodiment of the present invention. The gable vent assembly 10 is secured over an opening (covered by the vent and therefore not visible in FIG. 1) in an exterior wall 12 of a structure 14. In FIG. 1 the structure 14 is depicted as a residential home, but it will be appreciated that the gable vent assembly 10 could just as easily be used to vent the attic areas of a wide variety of commercial structures. As such, the assembly 10 of the present invention is not limited to residential dwellings but will find utility in a variety of applications. It will also be noted that while the structure 14 is shown with siding 16 thereon, that the gable vent assembly 10 is just as easily secured to new construction having walls which do not yet have any siding thereon.

Figure 2:
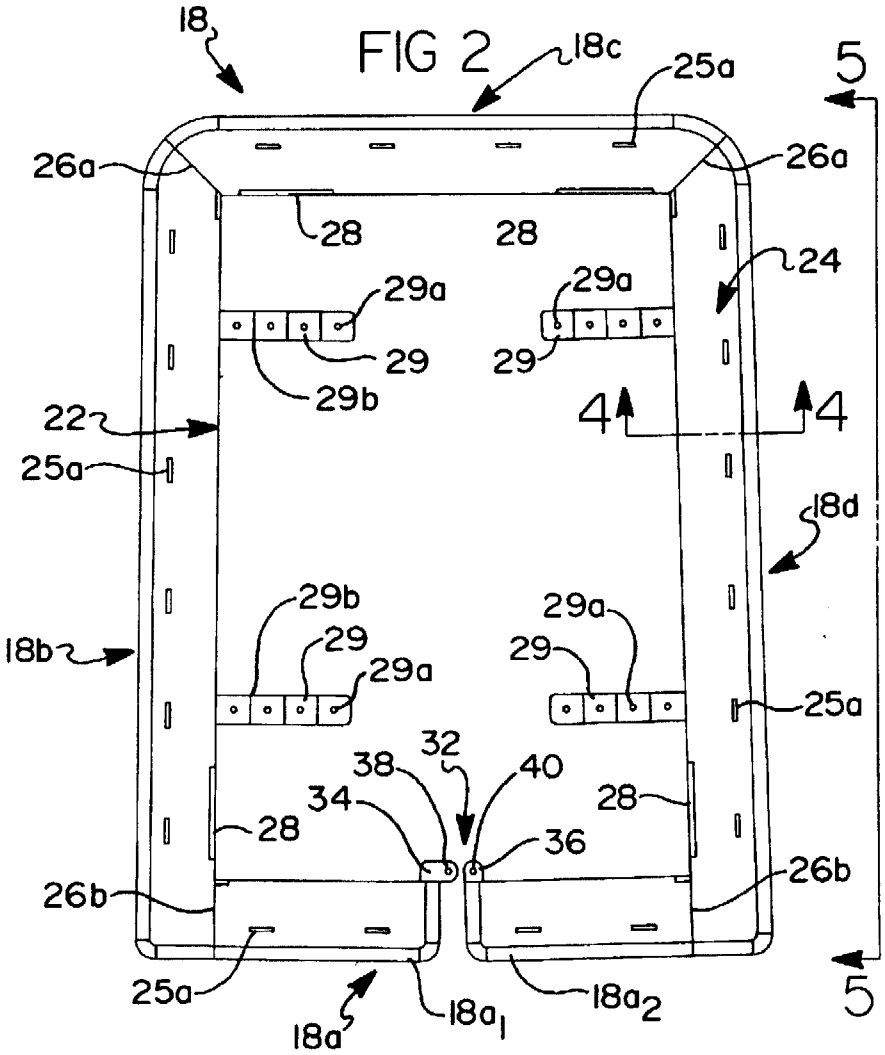
FIG. 2 is a front view of the mounting ring of the gable vent assembly.
Figure 3:
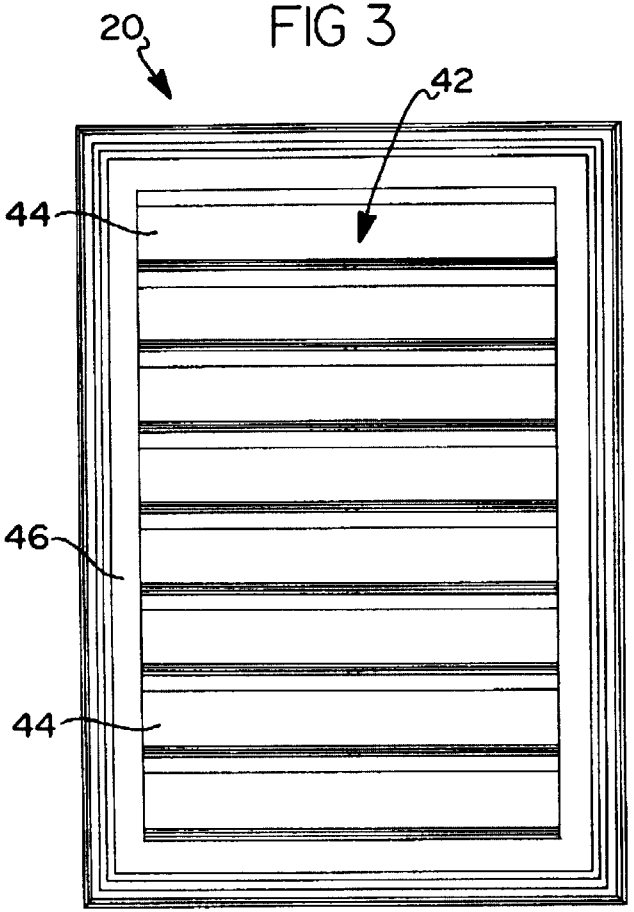
FIG. 3 is a front view of the cover member of the assembly.

With reference to FIGS. 2 and 3, the gable vent assembly 10 includes a one-piece mounting ring 18 (FIG. 2) and an integrally formed, louvered cover member 20 (FIG. 3). With further specific reference to FIG. 2, the mounting ring 18 is comprised of a plurality of distinct lengths or sections **18*a*–18*d*, although it will be immediately appreciated that a greater or lesser number of lengths will be present depending upon the desired shape of the assembly 10. For example, if the cover member 20 is in the form of a pentagon or hexagon, then the mounting ring 18 will be comprised of five or six distinct lengths, respectively. Length 18*a* is further formed having a first portion $18a_1$ and a second portion $18a_2$. By separating one of the lengths 18*a*–18*d*, the mounting ring 18 can be more easily manipulated when installing the mounting ring 18 to a structure which already has siding 16 secured thereon, and where a portion of the mounting ring 18 must be manipulated underneath portions of the siding 16**.

Referring to FIGS. 2, 4, 4A and 5, the mounting ring 18 also includes a mounting wall 22 and a mounting flange portion 24, each of which are coextensive with each one of the lengths **18*a*–18*d*. With specific reference to FIG. 2, the mounting flange 24 includes a plurality of spaced apart, slot-like openings 25*a*. Score lines 26*a* are formed at 45° angles to the length 18*c*. Score lines 26*b* extend perpendicular to length 18*a*. The score lines 26 do not extend through the mounting flange portion 24 but rather only up to the mounting wall 22. Score lines 26 may be quickly and easily cut through with a utility knife or other like instrument to provide even further flexibility to the mounting ring 18 should such extra flexibility be needed when installing the mounting ring 18 to structures which already have siding secured thereto. Again, it is anticipated that the score lines 26 will not need to be cut when installing the mounting ring 18** to the wall of a new structure which does not have any siding secured thereto.

The mounting ring 18 also includes a plurality of flexible plastic connecting straps 29 integrally formed with the mounting wall 22. Each connecting strap 29 includes a plurality of apertures **29*a* suitably sized to permit a nail or threaded screw to be inserted therethrough. Each connecting strap 29 is further formed as a plurality of distinct segments separated by hinged areas 29b which enable the straps 29 to be bent or formed around framing members forming the opening over which the mounting ring 18** is secured. This will be described in greater detail in the following paragraphs.

With further reference to FIG. 4, the mounting wall 22 extends generally orthogonally to the mounting flange 24. A portion of length 18c can also be seen to include a first securing portion 28. In practice, the mounting ring 18 preferably includes a plurality of first securing portions 28 formed on various ones of the lengths 18a–18d. Each first securing portion 28 includes a plurality of grooves 30, shown in FIG. 4A, which form shoulder or edge portions which extend longitudinally parallel to the major length of length 18c and parallel to one another. It will be appreciated that the grooves 30 could vary widely in number, height, length and depth. Providing a plurality of grooves 30 enables a degree of adjustability in the spacing of the cover member 20 relative to the mounting ring 18, as will be described in greater detail momentarily.

With further reference to FIG. 2, the mounting ring 18 includes a connection portion 32 comprised of a first lip portion 34 and a second lip portion 36. The first lip portion 34 includes a tab 38 formed thereon which projects generally perpendicularly from the first lip portion 34. The second lip portion 36 includes an aperture 40 positioned to engage with the tab 38 when the first and second portions $18a_1$ and $18a_2$ of length 18a are positioned adjacent to one another against a flat surface. The second lip portion 36 is further formed on the second portion $18a_2$ such that it is spaced slightly above the flange portion 24, and therefore rests flush on the first lip portion 34 when the two lip portions 34 and 36 are secured together. Of course, this arrangement could be reversed and the second lip portion 36 could include the tab 38 while the first lip portion 34 includes the aperture 40.

Figure 6:
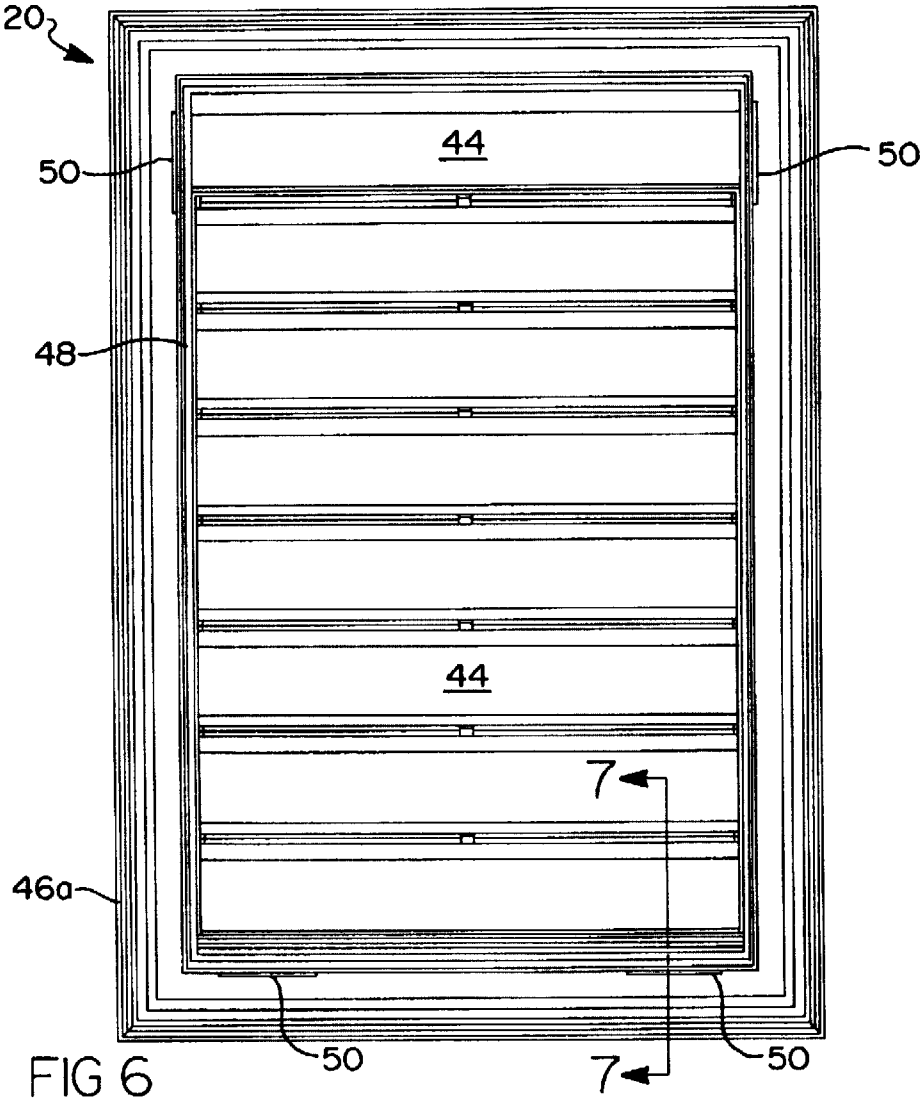
FIG. 6 is a rear view of the cover member of FIG. 3.

Referring now to FIGS. 3 and 6, the cover member 20 includes a central portion 42 formed by a plurality of louvers 44 for permitting airflow through the cover member 20. The louvers 44 are circumscribed by a continuous, decorative face panel 46. The louvers 44 and the decorative face panel 46 are integrally formed to form a rigid yet lightweight component.

Figure 7:
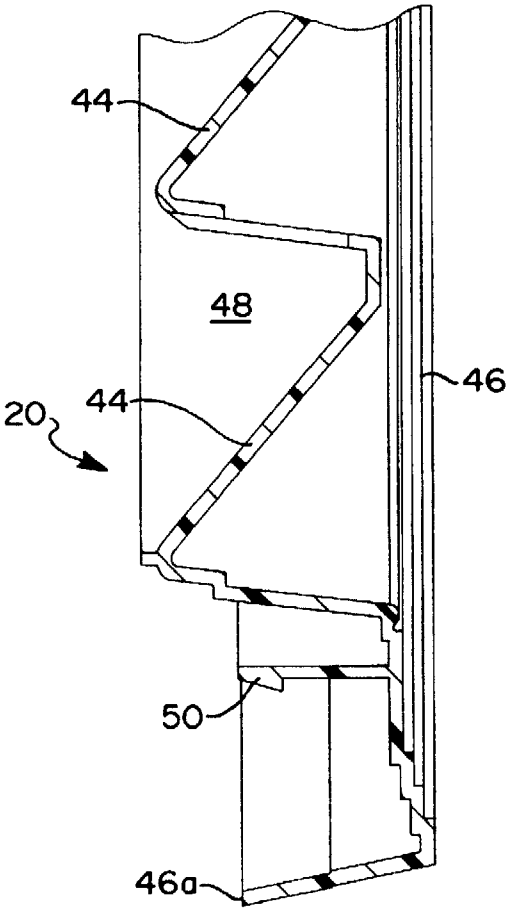
FIG. 7 is a cross-sectional view of a portion of the cover member according to section line 7—7 in FIG. 6.

With specific reference to FIG. 6, an inner edge surface 46a of the decorative face panel 46 includes an interior projecting wall 48 which completely circumscribes the louvers 44. The interior projecting wall 48 has formed thereon a plurality of second securing portions in the form of shoulder portions 50, one of which is shown in cross section in FIG. 7. Each of the shoulder portions 50 are further formed on the interior projecting wall 48 such that they align with the first securing portions 28 on the mounting ring 18 when the cover member 20 is positioned over the mounting ring 18. The shoulder portions 50 engage with the grooves 30 of their associated first securing portions 28 to allow the cover member 20 to be adjustably spaced from the mounting ring 18. This allows clearance for portions of siding having various thicknesses to fit inbetween the inner edge surface 46a of the decorative face panel 46 and the mounting flange 24 of the mounting ring 18. In this regard it will be appreciated that the overall exterior dimensions of the interior projecting wall 48 are slightly less than the interior dimensions of the mounting wall 22 of the mounting ring 18. In this manner the interior projecting wall 48 can readily be inserted within the interior area defined by the mounting wall 22 without interference from any portion of the mounting ring 18 except for the engagement of shoulder portions 50 with the first securing portions 28. Alternatively, it should be appreciated that the grooves 30 formed on the mounting wall 22 could be formed on the interior projecting wall 48 and the shoulder portions 50 instead formed on the mounting wall 22 to achieve the same form of securing of the mounting ring 18 to the cover member 20. The mounting ring 18 and cover member 20 are independent components which are each completely integrally formed, preferably by injection molding, from a suitable thermoplastic such as polypropylene or polystyrene. As such, the cover member 20 can readily be formed from thermoplastics of various colors and therefore does not need to be painted or stained. However, this does not preclude the cover member 20 from being painted to match existing exterior siding or trim of a building.

Referring now to FIGS. 8–14, the installation of the gable vent assembly 10 to the exterior wall 12 of the structure 14 will be described. With specific reference to FIG. 8, the existing gable vent (not shown) is removed to expose the opening 52 over which the new gable vent assembly 10 will be secured. Preferably, the siding 16 is trimmed so as to leave about 0.25" or so of space between the edges of the siding 16 and the perimeter of mounting wall 22. Of course, the opening 52 could be considerably smaller than the perimeter of the mounting wall 22, provided a sufficient portion of the siding is trimmed away to permit mounting of the mounting ring 18.

With specific reference to FIG. 9, all four of the score lines 26 on the mounting ring 18 should be cut with a utility knife to enable added flexibility to manipulate one corner 24a of the mounting flange 24 partially under an edge 16a of the siding 16 while the connecting portion 32 is disengaged to allow the first and second portions $18a_1$ and $18a_2$ to be manipulated as needed.

Referring to FIG. 10, once one corner 24a is manipulated into place, a second corner 24b is similarly manipulated into place such that the corner 24b extends partially underneath a portion of the siding 16. In FIG. 11 a third corner 24c and a fourth corner 24d are likewise manipulated into place. The first and second lip portions 34 and 36, respectively, of the connecting portion 32 are then secured together.

Figure 13:
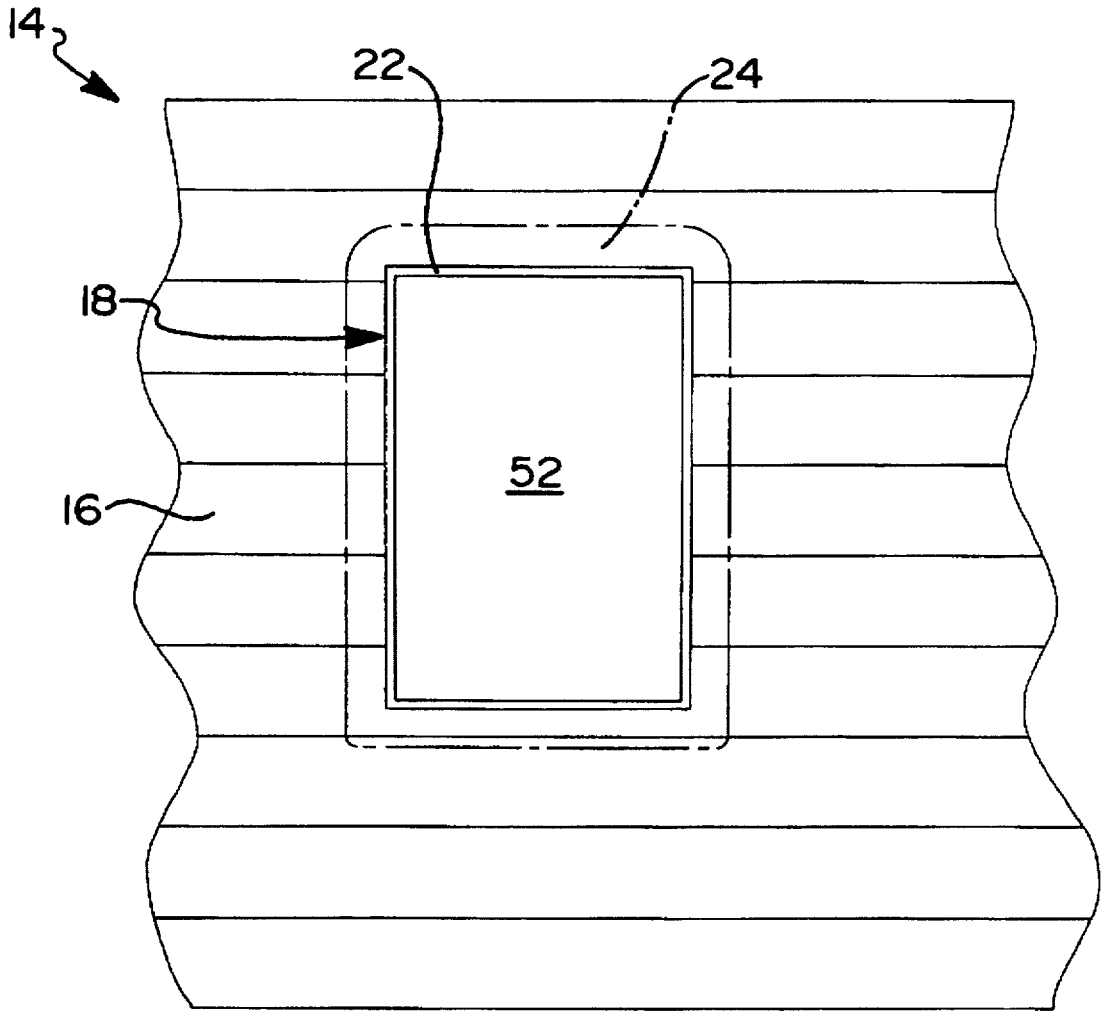
FIG. 13 is a view showing the mounting ring fully secured over the opening and ready to accept the cover member.

With brief reference to FIGS. 12A and 12B, the interlocking of the first and second lip portions 34 and 36, respectively, can be seen. In FIG. 12C one of the connecting straps 29 is shown secured to a framing member 12a defining the opening 52, via a nail 31. If no framing member is present, for example, if only an opening is cut into the wood siding 12, then the straps 29 can be around the edge of the siding 12 and secured to the interior surface of the wood siding 12. The completely secured mounting ring 18 is shown in FIG. 13 ready to accept the cover member 20. It will be appreciated then that the width of the mounting flange 24 is large enough to permit at least a small portion thereof to be inserted underneath the edges of the siding 16 around the entire periphery of the mounting ring 18.

Referring to FIG. 14, the cover member 20 is aligned with the opening 52 and pressed over the mounting wall 22 of the mounting ring 18. The decorative face panel 46 of the cover member 20 is of dimensions sufficient to completely cover the exposed edges of the siding 16 so that the entire opening 52 is hidden behind the cover member 20. The cover member 20 is shown secured to the mounting ring 18 in FIG. 15.

Figure 16:
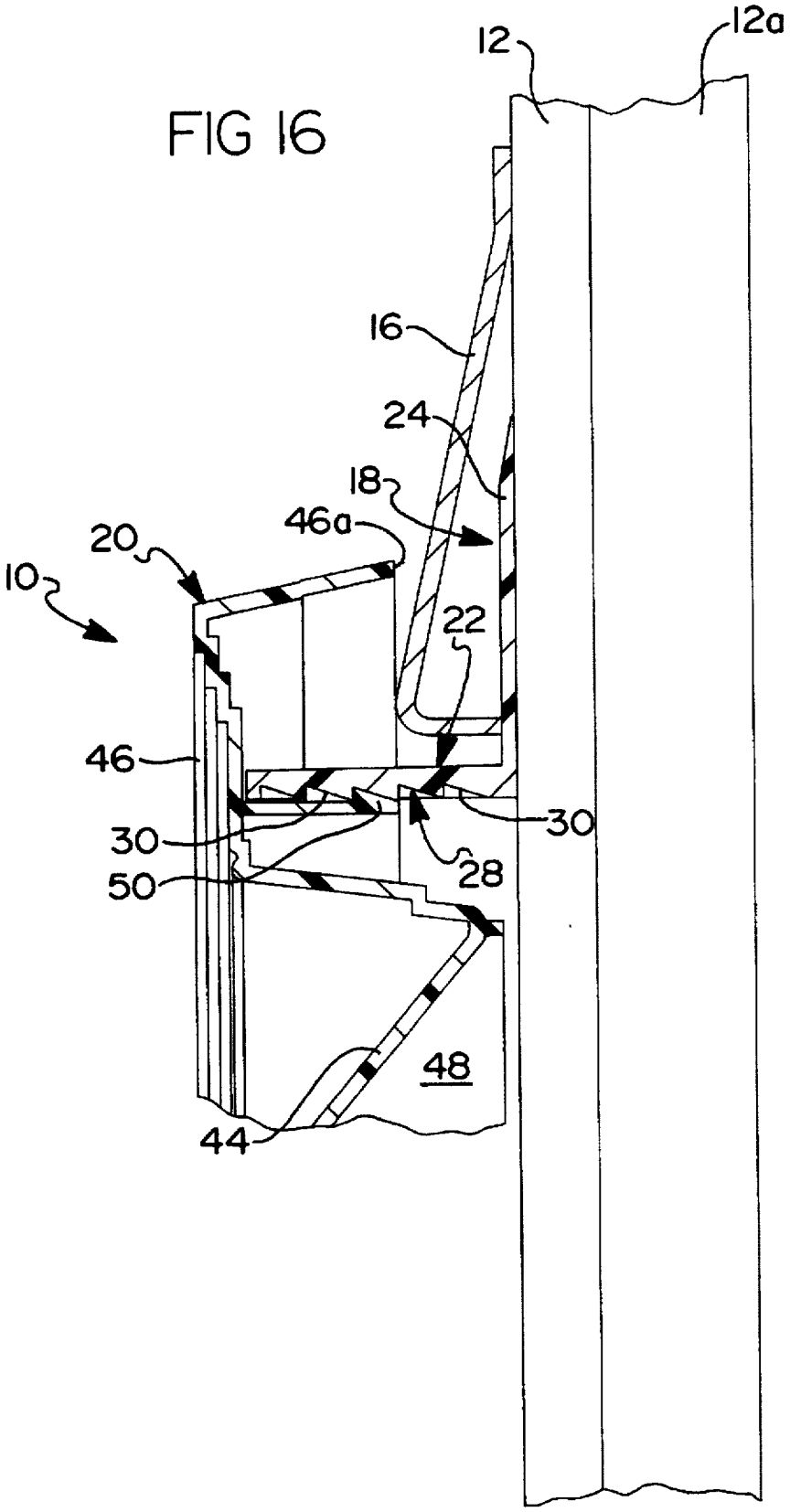
FIG. 16 is a cross sectional view in accordance with section line 16—16 in FIG. 15 showing a portion of the cover member secured to the mounting flange of the mounting ring.

FIG. 16 shows one of the shoulder portions 50 engaged with an associated one of the first securing portions 28. From FIG. 16 it can be seen how pressing further on the cover member 20, once it becomes engaged with one of the grooves 30, will cause the cover member 20 to be positioned and held closer to the wall 12, thus providing a degree of adjustability between the spacing of the components 18 and 20.

The above description of installation of the gable vent assembly 10 presumes that there is siding 16 secured to the wall 12 of the structure 14. If no siding 16 is present, such as if the structure 14 is a new structure undergoing construction, the mounting ring 18 may be secured over the opening 52 with threaded screws or nails extending through the openings 25*a* while the first and second lip portions 34 and 36 of the mounting ring 18 are secured together. There will be no need to cut the score lines 26. In this instance, no manipulation of the sections 18*a*–18*d* is needed to install the mounting ring 18. Thus, the gable vent assembly 10 can be used just as easily with existing or new construction. Since the mounting ring 18 and cover member 20 are each formed from a thermoplastic, each is resistant to cracking, splitting, insect damage and other occurrences which wood gable vent assemblies suffer from. The gable vent assembly 10 of the present invention is further lightweight, readily inexpensive to construct, and does not require any special tools or complicated installation procedures to install.

What is claimed is:

1. A gable vent assembly comprising:

a mounting ring, said mounting ring being comprised of a material at least somewhat flexible and having a cut along one length thereof to form two terminal end portions to thereby enable said ring to be manipulated into position over an opening in a wall of a structure, said mounting ring further including connecting portions for securing said terminal end portions of said one length securely adjacent to one another, and said mounting ring further including at least one first securing portion; and a cover member securable to said mounting ring, said cover member including, at least one second securing portion adapted to engage with said first securing portion to hold said cover member attached to said mounting ring when said cover member is positioned against said mounting ring.

2. The apparatus of claim 1, wherein said mounting ring includes a mounting flange and a plurality of spaced apart openings in said mounting flange for enabling said mounting flange to be secured said wall of said structure so as to circumscribe a gable vent opening provided in said wall of said structure.

3. The apparatus of claim 2, wherein said mounting ring includes a mounting wall extending substantially orthogonally to said mounting flange.

4. The apparatus of claim 3, wherein said mounting flange includes a plurality of spaced apart openings for permitting external fasteners to secure said mounting flange to said wall of said structure.

5. The apparatus of claim 3, wherein said connecting portions comprise:

a first lip portion protruding generally orthogonally from said mounting wall, said first lip portion including a tab protruding therefrom, said lip being disposed closely adjacent one of said terminal end portions; and a second lip portion protruding generally orthogonally from said mounting wall closely adjacent the other one of said terminal end portions, said second lip portion including an aperture through which said tab is received when said terminal end portions are positioned closely adjacent one another, and wherein engagement of said tab within said aperture secures said terminal end portions closely adjacent one another such that same cannot be readily separated.

6. The apparatus of claim 3, wherein said first securing portion comprises a series of adjacent, longitudinally extending grooves formed in said mounting wall; and wherein said second securing portion includes a shoulder portion formed on an interior projecting wall of said cover member.

7. A cover assembly for covering an opening formed in a wall of a building, and wherein longitudinal strips of siding cover said wall of said structure except for said opening, said cover assembly comprising:

a mounting ring including a mounting wall having outer dimensions adapted to be similar to dimensions of said opening and being shaped similar to said opening, said mounting wall having a plurality of distinct lengths and at least a pair of mounting flanges integrally formed with at least two of said distinct lengths;

said mounting ring being formed from a material such that said distinct lengths are at least slightly flexible and at least one of said distinct lengths being cut to form first and second terminal end portions;

said mounting ring including a connecting portion for securing said terminal end portions together adjacent one another;

said mounting ring further comprising at least one first securing portion on said mounting wall; and an independent cover member for at least partially covering said opening, said cover member including a projecting wall portion having a second securing portion adapted to engage with said first securing portion of said mounting ring when said cover member is positioned adjacent to said mounting ring such that said cover member may be releasably secured to said mounting ring to cover said opening.

8. The cover assembly of claim 7, wherein said pair of mounting flanges have dimensions adapted to be sufficient to enable each to extend partially in between an exterior surface of said wall of said building and portions of said siding secured to said building to help secure said mounting ring over said opening in said wall of said building.

9. The cover assembly of claim 7, wherein said connecting portion comprises a first lip portion formed adjacent said first terminal end portion of said one length and a second lip formed adjacent said second terminal end portion of said one length; said first lip portion including a tab projecting therefrom; and said second lip portion including an aperture positioned to engage with said tab when said first and second terminal end portions of said one length are positioned closely adjacent to one another to thereby hold said portions together.

10. The cover assembly of claim 7, wherein said cover member comprises a gable vent.

11. The cover assembly of claim 7, wherein said mounting wall of said mounting ring comprises a plurality of first securing portions, each said first securing portion comprising a plurality of longitudinal grooves formed in said mounting wall; and wherein said second securing portions of said cover member comprise a plurality of shoulder portions formed on said projecting wall portion, said shoulder portions being adapted to engage with said grooves to releasably secure said cover member to said mounting ring.

12. A gable vent assembly for covering a opening in a wall of a structure, said assembly comprising:

a mounting ring having a mounting wall and at least three distinct lengths, one of said lengths being formed in first and second portions, said mounting ring further being comprised of a material enabling at least one of said lengths to be flexed slightly to facilitate installation in securing to said wall said mounting wall having a first securing portion;

said mounting ring further comprising first and second connecting portions associated with said one length which is formed in first and second portions for securing said first and second portions of said one length together; and a cover member having a decorative face panel and an interior projecting wall portion extending generally perpendicularly from, and integrally formed with, said decorative face panel, said interior projecting wall portion including a second securing portion adapted to engage with said first securing portion of said mounting wall to hold said cover member to said mounting ring.

13. The assembly of claim 12, wherein said mounting ring includes at least one flange portion for enabling said mounting ring to be fixedly secured to said wall of said structure.

14. The assembly of claim 12, wherein said mounting ring comprises a plurality of said flange portions each having at least one opening therein for permitting each of said flange portions to be fixedly secured to said wall of said structure.

15. The assembly of claim 13, wherein said mounting ring includes a plurality of said flange portions extending generally orthogonally from said distinct lengths; and wherein each said flange portion includes at least one opening for enabling a plurality of external fastening elements to be used to secure said flange to said wall of said structure.

16. The assembly of claim 12, wherein said mounting ring includes a plurality of said first securing portions, each said first securing portion including at least one groove for engaging with said second securing portion of said cover member.

17. The assembly of claim 16, wherein said first securing portions each include a plurality of said grooves for enabling said cover member to be adjustably spaced from said wall of said structure when said cover member is secured to said mounting ring.

18. The assembly of claim 17, wherein said grooves of each of said first securing portions extend generally parallel to one another.

19. The assembly of claim 12, wherein said connecting portions comprise:

first and second lip portions, said first lip portion including a tab and said second lip portion including an aperture for engaging with said tab when said first and second portions of said one length which is cut are brought together into abutting relationship.

20. The assembly of claim 12, wherein said first securing portion is formed on an inner surface of said mounting wall of said mounting ring; and wherein said second securing portion is formed on an exterior surface of said interior projecting wall of said cover member; and wherein said interior projecting wall of said cover member is insert within a periphery of said mounting wall such that said first and second securing portions engage to secure said cover member to said mounting ring.

21. A method for securing a cover assembly to cover an opening in a wall of a structure, wherein said wall includes a plurality of lengths of siding circumscribing the perimeter of said opening, said method comprising the steps of:

placing a mounting ring having a plurality of distinct lengths, one of said lengths being separated into two lengths, and wherein said mounting ring includes a plurality of integrally formed flanges adapted to be placed around said opening such that said flanges extend at least partially underneath said lengths of siding and such that said mounting ring circumscribes substantially the entire periphery of said opening;

providing at least one first securing portion in said mounting ring which is accessible after said mounting ring is positioned around said opening;

providing a cover member having a wall portion including a second securing portion; and placing said cover member over said mounting ring such that said second securing portion abuttingly engages with said first securing portion to hold said cover member to said mounting ring, thereby covering said opening.

* * * * *